US005243951A

United States Patent [19]

Nakaniwa

[11] Patent Number: 5,243,951

[45] Date of Patent: Sep. 14, 1993

[54] METHOD OF AND APPARATUS FOR LEARNING AND CONTROLLING AIR-FUEL RATIO OF INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 690,985

[22] PCT Filed: Oct. 31, 1990

[86] PCT No.: PCT/JP90/01405

§ 371 Date: Jun. 25, 1991

§ 102(e) Date: Jun. 25, 1991

[87] PCT Pub. No.: WO91/06755

PCT Pub. Date: May 16, 1991

[30] Foreign Application Priority Data

Nov. 1, 1989 [JP] Japan ..... 1-282883

[51] Int. Cl.[5] ..... F02M 7/00

[52] U.S. Cl. ..... 123/674

[58] Field of Search ..... 123/674, 486, 480

[56] References Cited

U.S. PATENT DOCUMENTS

| | | | |
|---|---|---|---|
| 4,705,002 | 11/1987 | Ando et al. | 123/674 |
| 4,733,357 | 3/1988 | Abo | 123/674 |
| 4,737,914 | 4/1988 | Abo et al. | 123/674 |
| 4,862,855 | 9/1989 | Manaka et al. | 123/674 |
| 5,050,562 | 9/1991 | Ishii et al. | 123/674 |
| 5,080,004 | 1/1992 | Bushapp et al. | 123/674 |

FOREIGN PATENT DOCUMENTS

| | | | |
|---|---|---|---|
| 58-192944 | 11/1983 | Japan | 123/674 |
| 60-90944 | 5/1985 | Japan | 123/674 |
| 61-190138 | 8/1986 | Japan | 123/674 |
| 61-190142 | 8/1986 | Japan | 123/674 |
| 63-45043 | 3/1988 | Japan | 123/674 |
| 63-223348 | 9/1988 | Japan | 123/674 |

*Primary Examiner*—Raymond A. Nelli

*Attorney, Agent, or Firm*—Foley & Lardner

[57] ABSTRACT

A system for learning and controlling the air-fuel ratio of each of divided regions of an operating range of an engine employs a plurality of learning maps in which the engine operating range is divided into regions of different sizes, and these regions are learned in descending order of their sizes. This system improves the convergence of the learning as well as the accuracy of a correction of an air-fuel ratio for each engine operating condition.

10 Claims, 11 Drawing Sheets

METHOD OF AND APPARATUS FOR LEARNING AND CONTROLLING AIR-FUEL RATIO OF INTERNAL COMBUSTION ENGINE

TECHNICAL FIELD

The present invention relates to a method of and an apparatus for learning and controlling the air-fuel ratio of an internal combustion engine, and particularly, to an improvement of a learning, correcting and controlling of the air-fuel ratio in each engine operating region of an electronically controlled fuel supply apparatus having an air-fuel ratio feedback correction control function.

BACKGROUND ART

An internal combustion engine having a electronically controlled fuel injection apparatus with an air-fuel ratio feedback correction control function employs an air-fuel ratio learning and controlling apparatus such as disclosed in Japanese Unexamined Patent Publication Nos. 60-90944 and 61-190142.

The air-fuel ratio feedback correction control function calculates a basic fuel injection quantity Tp according to engine operating parameters such as an inlet airflow quantity Q and an engine rotation speed N which influence the quantity of intake air to the engine. At the same time, an oxygen sensor disposed in an engine exhaust system determines if an actual air-fuel ratio is rich or lean with respect to a target air-fuel ratio (a theoretical air-fuel ratio), and according to the whether it is rich or lean, an air-fuel ratio feedback correction coefficient LMD is set. The basic fuel injection quantity Tp is corrected according to the air-fuel ratio feedback correction coefficient LMD, thereby carrying out a feedback control and adjusting of the quantity of fuel to be supplied to the engine, to bring the actual air-fuel ratio close to the target air-fuel ratio.

A deviation of the air-fuel ratio feedback correction coefficient LMD from a reference value (a target of convergence) is learned for each of divided regions of an engine operating range, to determine a learned correction coefficient KBLRC by which the basic fuel injection quantity Tp is corrected to match the basic air-fuel ratio substantially with the target air-fuel ratio before applying the correction coefficient LMD. Thereafter, a further feedback correction of the air-fuel ratio with the correction coefficient LMD is carried out to provide a final fuel injection quantity Ti.

This kind of air-fuel ratio learning and controlling function can correct an air-fuel ratio according to engine operating condition, and stabilize the air-fuel ratio feedback correction coefficient LMD around the reference value, to thereby improve the controllability of the air-fuel ratio.

An engine operating range is divided into regions based on, for example, basic fuel injection quantities Tp and engine rotation speeds N indicating an engine load, to learn a correction coefficient KBLRC for each of the divided regions.

When the engine operating range for learning the correction coefficients KBLRC is roughly divided, it is impossible to accurately follow the differences of the correction requirements of the respective divided regions. On the other hand, when a very fine division of the engine operating range is made, the ability to learn each of the divided regions is reduced, which deteriorates the convergence of the learning. Also, learned and unlearned regions of the divided regions may be mixed with one another to produce stepwise differences between the respective correction values for the divided regions.

Accordingly, a conventional technique divides the engine operating range into a number of regions by which the learning convergence and the controlling accuracy are improved to some extent. When newly learning the air-fuel ratio of an engine of a just-delivered car or when dealing with a sudden change in a basic air-fuel ratio of an engine due to a fault such as a hole in an inlet system of the engine, it takes time to learn and optimize the correction coefficient KBLRC. Namely, the learning process requires a certain time to reach a target air-fuel ratio, and during this period, the drivability and exhaust condition of the engine may be adversely influenced.

The variation of the quantity of intake air of the engine varies is greater when the engine is operating in a low load range than when operating in a high load range, and thus it is preferable to more precisely divide the low load operating range of the engine than the high load operating range thereof, when learning the correction coefficients KBLRC, to ensure an accurate control of the air-fuel ratio of the engine. If a hole is accidentally formed in an inlet system of the engine, air sucked through this hole causes a divergence of the air-fuel ratio, and the extent of the divergence becomes larger as the load on the engine becomes smaller, because a ratio of the air sucked through the hole to the total quantity of intake air becomes larger as the load on the engine becomes smaller. When the engine operating range is divided into small regions, therefore, the learning of the small regions may not progress smoothly, and thus large stepwise differences between the divided regions occur. In the low load region of the engine, in particular, it is difficult to improve the learning convergence and the learning correction accuracy for each engine driving condition.

In consideration of these circumstances, an object of the invention is to provide a method of and an apparatus for learning and controlling the air-fuel ratio of an internal combustion engine, which can properly converge the learning of respective air-fuel ratio correction values of divided regions of an engine operating range, and prevent a stepwise difference between the divided regions due to the air-fuel ratio.

DISCLOSURE OF THE INVENTION

To achieve this object, a method of learning and controlling the air-fuel ratio of an internal combustion engine according to the invention comprises the steps of, dividing the operating range of the internal combustion engine into regions of different sizes; preparing a plurality of learning maps for storing learned air-fuel ratio correction values for the divided regions, respectively, the stored correction values being able to be rewritten; setting a basic fuel supply quantity according to engine operating condition involving at least a parameter related to the quantity of intake air to the engine; comparing the detected air-fuel ratio of a mixture of gases drawn into the engine with a target air-fuel ratio to set an air-fuel ratio feedback correction value for correcting the basic fuel supply quantity to bring an actual air-fuel ratio close to the target air-fuel ratio; learning a deviation of the air-fuel ratio feedback correction value from a reference value; updating the learned air-fuel ratio correction values of the divided regions of the engine operating range in order of the sizes of the regions on the learning maps, such that the deviation is reduced; and supplying fuel to the engine according to a fuel supply quantity finally set according to the basic fuel supply quantity, the air-fuel ratio feedback correction value, and the learned air-fuel ratio correction value of a corresponding one of the divided regions of the engine operating range.

The learning maps for storing the learned air-fuel ratio correction values for the divided regions involve a learning map in which the engine operating range is divided into large regions, and another learning map in which the engine operating range is divided into small regions. The learning process is first carried out on the learning map with the large regions, to thereby ensure a good convergence of the learning. As the learning proceeds, the learning map with the small regions is used to accurately deal with different correction requirements for different engine driving conditions.

It is preferable to detect a deviation of the air-fuel ratio feedback correction value from a target of convergence, and when the deviation exceeds a predetermined extent, repeat the learning process from the large regions of the engine operating range.

Even if the learning proceeds from the large regions to the small regions, a result of the learning may be incorrectly for some reason (such as an accident whereby a hole is formed in an inlet system of the engine), but even in such a case, it is possible to quickly converge the air-fuel ratio by repeating the learning from the large regions of the engine operating range.

It is preferable to find a learned region among divided regions of the engine operating range on the learning map, and according to a learned air-fuel ratio correction value stored in the learned region, correct and update learned air-fuel ratio correction values stored in unlearned regions around the learned region.

When the engine operating range is divided into small regions, the ability to learn each region may be reduced, to thereby deteriorate the learning convergence. Since there are no big differences in the correction requirements of the small regions, the learned air-fuel correction value of a learned one of the small regions may be used to rewrite and correct correction values of other small regions around the learned region. This may prevent a stepwise difference between the small regions due to the air-fuel ratio, even if the ability to learn is small.

A learned air-fuel ratio correction value stored in a particular one of the divided region on the learning map may be rewritten according to learned air-fuel ratio correction value stored in a plurality of subdivided regions formed by subdividing the particular divided region.

When each of the divided regions of the engine opertin g range is subdivided into small regions and the learning is carried out for each of the subdivided regions, the correction requirements of the regions may be accurately met. Any one of the large regions may be learned with a particular driving condition contained in the large region. Accordingly, the results of the learning of the subdivided regions are fed back to a result of the learning of the large region including the subdivided regions, to thereby improve the accuracy of the learning of the large region.

It is preferable to rewrite the learned air-fuel ratio correction value of a particular divided region in the learning map after resetting and initializing the learned air-fuel ratio correction values of the subdivided regions contained in the particular divided region.

The learning of the particular large region must average the correction request levels of the respective subdivided regions contained in the large region. If the learning is made for each of the subdivided regions, a correction component to be originally borne by the large region is added to the subdivided regions, thereby deteriorating the accuracy of the learning of the large region. Accordingly, the learning of the large region is carried out after resetting and initializing the learned values of the subdivided regions contained in the large region, and thus the air-fuel ratio may be controlled to some extent by only a result of the learning of the large region.

An apparatus for learning and controlling the air-fuel ratio of an internal combustion engine comprises an operating condition detecting means for detecting the operating condition of the engine, including at least an operating parameter related to the quantity of intake air to the engine; a basic fuel supply quantity setting means for setting a basic fuel supply quantity according to the engine operating condition detected by the operating condition detecting means; an air-fuel ratio detecting means for detecting the air-fuel ratio of a mixture of gases drawn into the engine; an air-fuel ratio feedback correction value setting means for comparing the air-fuel ratio detected by the air-fuel ratio detecting means with a target air fuel ratio and determining an air-fuel ratio feedback correction value for correcting the basic fuel supply quantity to bring an actual air-fuel ratio close to the target air-fuel ratio; a plurality of learning maps in which an engine operating range is divided into regions of different sizes; a learned correction value storing means for storing learned air-fuel ratio correction values of the divided regions in the learning maps; a learned correction value rewriting means for learning a deviation of the air-fuel ratio feedback correction value determined by the air-fuel ratio feedback correction value setting means from a target of convergence, and rewriting learned air-fuel ratio correction values stored in the learned correction value storing means one by one to reduce the deviation; a learning progress control means for controlling the learned correction value rewriting means such that the learned air-fuel ratio correction values stored in the divided regions are rewritten in a descending order of the sizes of the divided regions in the learning maps of the learned correction value storing means; a fuel supply quantity setting means for correcting the basic fuel supply quantity according to a learned air-fuel ratio correction value which corresponds to the present engine operating condition and stored in the learning map of the learned correction value storing means, as well as the air-fuel ratio feedback correction value, to thereby provide a final fuel supply quantity; and a fuel supply control means for controlling and driving a fuel supply means according to the fuel supply quantity set by the fuel supply quantity setting means.

The learning correction value storing means involves a plurality of learning maps in which the engine operating range is divided into regions of different sizes. The maps comprise a learning map in which the engine operating range is divided into large regions, and another learning map in which the engine operating range is divided into small regions. The learning progress control means learns the divided regions sequentially, starting from the large ones in the learning maps. Learning the divided regions from the larger ones ensures the convergence of the learning. As the learning progresses, the small regions are learned to accurately satisfy correction requirements of the respective regions.

If the deviation exceeds a predetermined level, it is preferable to provide a learning repeating means for detecting a deviation of the air-fuel ratio feedback correction value from a target of convergence, and repeating the learning from the large regions of the engine operating range.

When the deviation of the air-fuel ratio is large and cannot be dealt with by the learned air-fuel ratio correction values, the learning repeating means repeats the learning from the large regions of the engine operating range so that the target air-fuel ratio may be quickly attained, even when the basic air-fuel ratio is suddenly changed.

It is preferable to provide an unlearned region estimating means for finding a learned region among the divided regions on the learning maps of the learned correction value storing means, and according to a learned air-fuel ratio stored in the found learned region, rewriting the air-fuel ratio correction values of unlearned driving regions around the found learned region.

Dividing the engine operating range into small regions may reduce the ability to learn each of the divided regions, and accordingly, the unlearned region estimating means rewrites the air-fuel ratio correction values of the unlearned regions around a learned region according to a learned value of the learned region, thereby avoiding a stepwise difference due to the air-fuel ratio between the divided regions because of a lack of ability to carry out the learning.

It is preferable to provide a means for rewriting the learned correction value of a certain one of the divided regions of the engine operating range in the learning map stored in the learned correction value storing means according to learned air-fuel ratio correction values stored in a plurality of subdivided regions contained in the certain region.

When the engine operating range is divided into small regions, the ability to learn each region may be reduced but this may increase the accuracy of a learned correction value stored in each of the regions. Namely, by feeding results of the learning of subdivided regions included in a large region back to the learning of the large region, the accuracy of the learning of the large region is improved.

It is preferable to provide a resetting means for resetting and initializing the learned air-fuel ratio correction values stored in subdivided regions contained in a certain large region of the engine operating range in the learning map of the learned correction value storing means when learning and rewriting a learned air-fuel ratio correction value of the certain large region.

In particular, if results of the learning of the subdivided regions contained in the certain large region remain when the learning repeating means repeats the learning process of the certain large region, the learning of the large region is influenced and hindered by the correction values stored in the subdivided regions. Accordingly, the learned values of the subdivided regions contained in the certain large region are reset to initial values before sequentially carrying out the learning of the large region.

BEST MODE OF CARRYING OUT THE INVENTION

Figure 1:
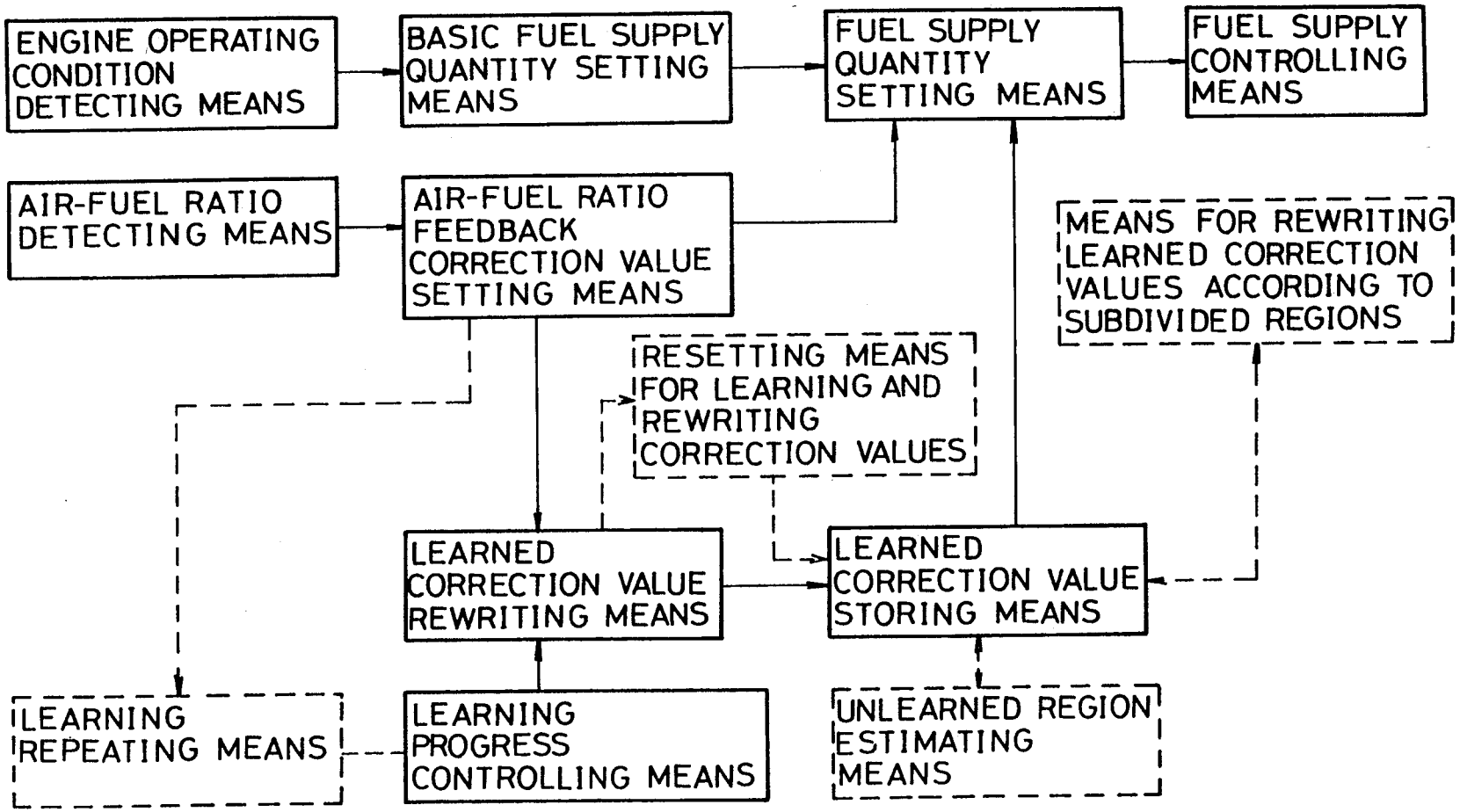
FIG. 1 is a block diagram showing an apparatus for learning and controlling the air-fuel ratio of an internal combustion engine according to the invention.

FIG. 1 is a view schematically showing an apparatus for learning and controlling the air-fuel ratio of an internal combustion engine according to the invention, and FIGS. 2 through 9 are views showing an embodiment of the same.

Figure 2:
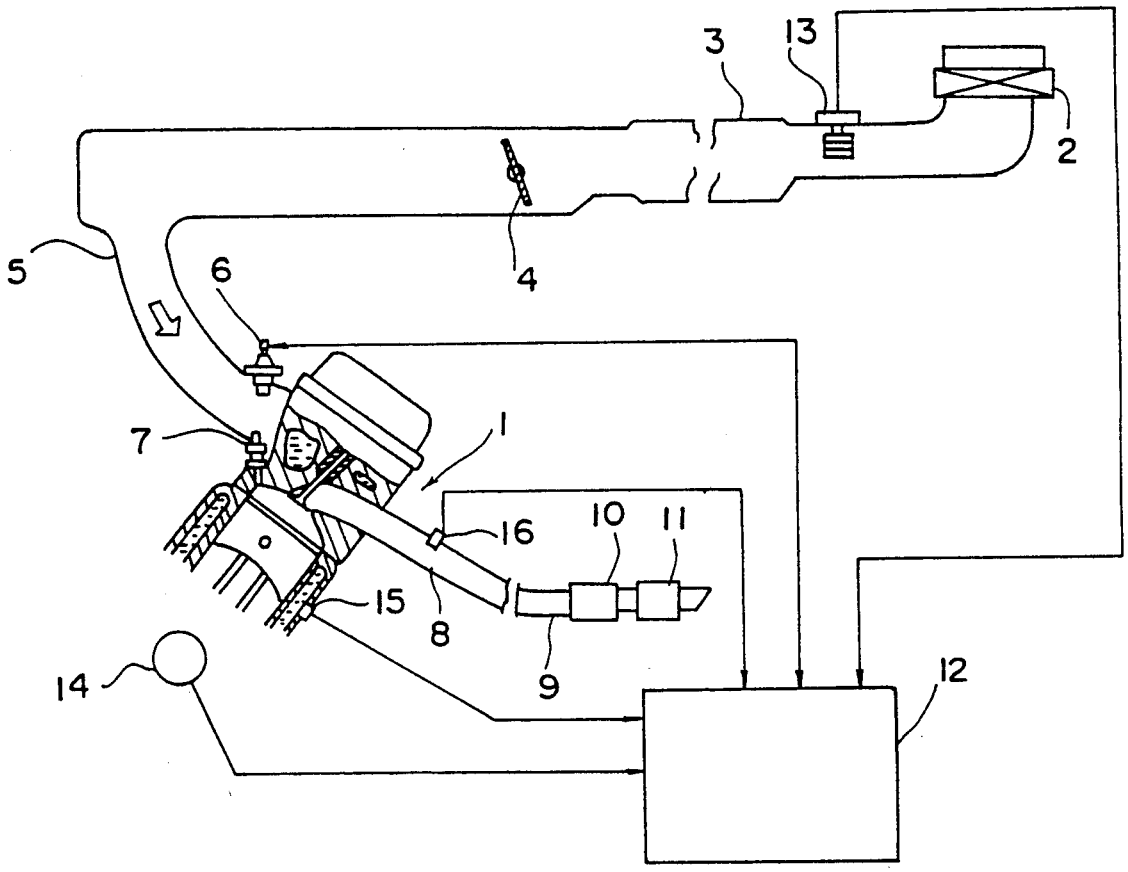
FIG. 2 is a schematic view showing an internal combustion engine system according to an embodiment of the invention for learning and controlling the air-fuel ratio of the internal combustion engine.

In FIG. 2, the internal combustion engine 1 draws in air through an air cleaner 2, an inlet duct 3, a throttle valve 4, and an inlet manifold 5. Each branch of the inlet manifold 5 for each cylinder of the engine 1 has a fuel injection valve 6. The fuel injection valve 6 is a normally closed solenoid fuel injection valve which opens when energized and closes when de-energized. Upon receiving a driving pulse signal from a control unit 12, the fuel injection valve 6 is energized to open to inject fuel which has been pressurized by a fuel pump (not shown) and adjusted to a predetermined pressure by a pressure regulator.

A combustion chamber of the engine 1 has a spark plug 7, which generates sparks to burn a mixture of gases.

An exhaust gas from the engine 1 is exhausted through an exhaust manifold 8, an exhaust duct 9, a catalytic converter rhodium 10, and a muffler 11.

The control unit 12 comprises a microcomputer involving a CPU, a ROM, a RAM, an A/D converter, and an input/output interface. The control unit 12 receives signals from various sensors and processes the signals to control the fuel injection valve 6.

One of the sensors is an airflow meter 13 disposed in the inlet duct 3 for providing a signal corresponding to an inlet air quantity Q of the engine 1, and another of the sensors is a crank angle sensor 14. Assuming that the engine 1 has four cylinders, the crank angle sensor 14 provides a reference signal REF for every 180 degrees of crank angle as well as a unit signal POS for every one or two degrees of crank angle, and an engine rotation speed N can be calculated by measuring the period of the reference signal REF or the number of unit signals POS to be generated in a predetermined time.

Still another of the sensors is a water temperature sensor 15 for detecting a cooling water temperature Tw in a water jacket of the engine 1.

The airflow meter 13, crank angle sensor 14, water temperature sensor 15, etc., form the engine operating condition detection means.

At a collecting portion of the exhaust manifold 8, an oxygen sensor 16 serves as the air-fuel ratio detecting means for detecting an oxygen concentration in the exhaust gas to determine the air-fuel ratio of the mixture of the intake air and fuel. The oxygen sensor 16 is known and utilizes a phenomenon that an oxygen concentration in an exhaust gas is steeply changed before and after a theoretical air-fuel ratio, to detect whether an actual air-fuel ratio is rich or lean with respect to the theoretical air-fuel ratio.

The CPU of the microcomputer incorporated in the control unit 12 runs programs stored in the ROM to carry out the processes shown in the flowcharts of FIGS. 3 through 7, thereby carrying out a feedback control of an air-fuel ratio, learning the correction control value of each engine operating region, setting a fuel injection quantity Ti, and controlling fuel to be supplied to the engine 1.

According to the embodiment, the basic fuel supply quantity setting means, fuel supply quantity setting means, fuel supply control means, air-fuel ratio feedback correction value setting means, learned correction value rewriting means, learning progress control means, learning repeating means, unlearned region estimating means, means for rewriting a learned correction value according to subdivided regions, and resetting means for learning and rewriting correction values are realized by software, as shown by the flowcharts of FIGS. 3 through 7. The learned correction value storing means corresponds to the RAM of the microcomputer.

Figure 3:
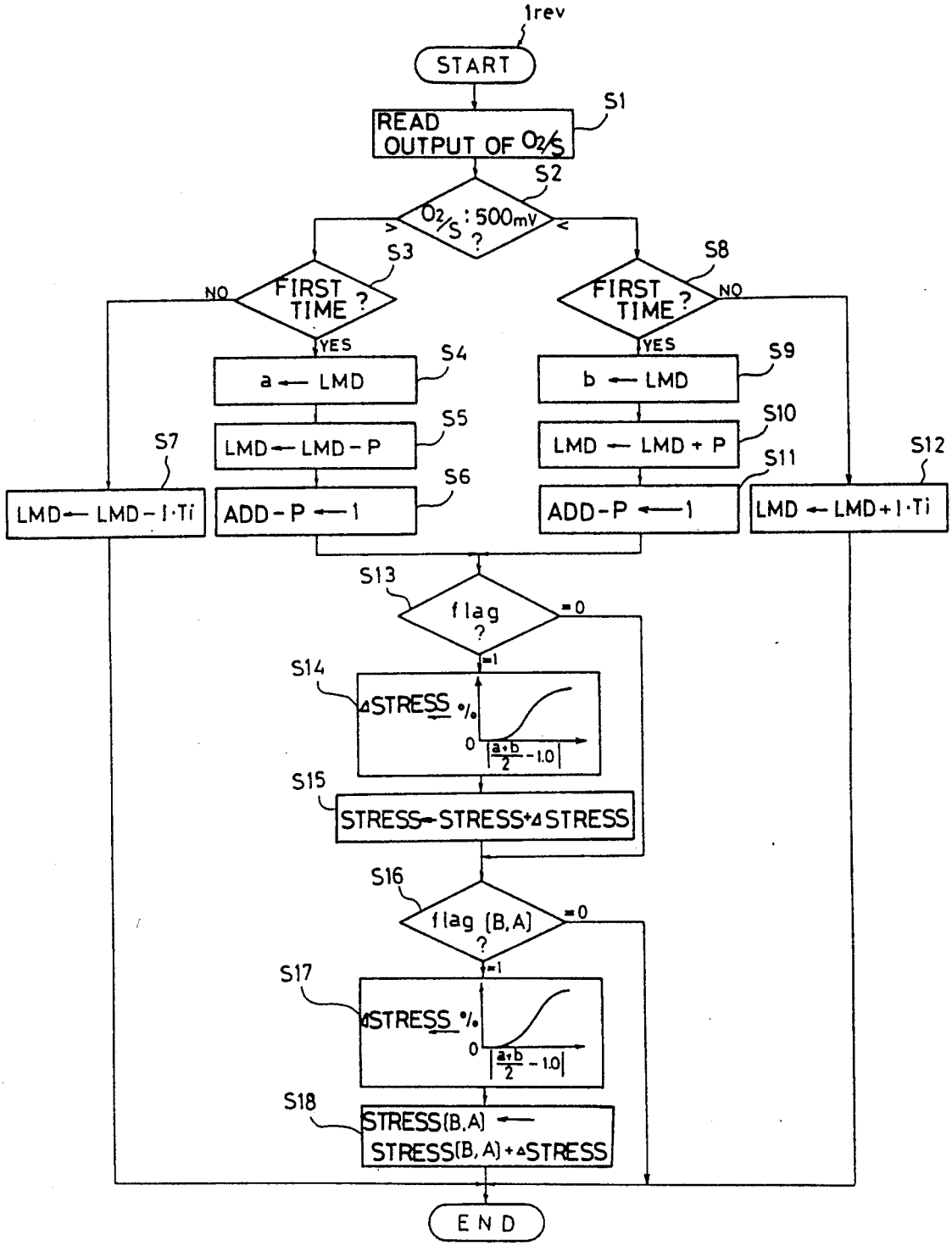
FIGS. 3, 4A–4C, 5, 6, 7A and 7B are flowcharts showing the control steps of the embodiment.

The program of the flowchart of FIG. 3 is used for carrying out a proportional-plus-integral control when setting an air-fuel ratio feedback correction coefficient (air-fuel ratio feedback correction value) LMD by which a basic fuel injection quantity $T_P$ is multiplied. This program is executed at each full rotation of the engine 1. An initial value (a target of convergence) of the air-fuel ratio feedback correction coefficient LMD is 1.

Step 1 (indicated as S1 in the figure) reads a voltage signal provided by the oxygen sensor 16 ($O_2$/S). The voltage signal corresponds to the oxygen concentration of an exhaust gas.

Step 2 compares the voltage signal from the oxygen sensor 16 read in step 1 with a slice level (for example 500 mV) corresponding to a target air-fuel ratio (a theoretical air-fuel ratio), and determines whether the air-fuel ratio of an air-fuel mixture of the engine 1 is rich or lean with respect to the target air-fuel ratio.

If the voltage signal from the oxygen sensor 16 is larger than the slice level, i.e., if the air-fuel ratio is rich, step 3 determines whether or not the rich determination is made for the first time.

If the rich determination is made for the first time, step 4 sets a previously set air-fuel ratio feedback correction coefficient LMD to a maximum value "a". The first time rich determination means that a preceding judgment was lean, and accordingly the air-fuel ratio feedback correction coefficient LMD was increased (the fuel injection quantity Ti was increased). In response to the rich determination, the correction coefficient LMD must be decreased. The maximum value of the correction coefficient LMD is equal to, therefore, its previous value just before it is reduced due to the first rich judgment.

To refuse the correction coefficient LMD, step 5 subtracts a predetermined proportional constant P from the previous correction coefficient LMD, and step 6 sets a flag ADD-P to 1 to indicate that the proportional control has been executed.

If step 3 determines the rich determination is not for the first time, step 7 multiplies a latest fuel injection quantity Ti by an integration constant I, and subtracts the multiplication result from the previous correction coefficient LMD, thereby updating the correction coefficient LMD. Until the rich state of the air-fuel ratio changes to a lean state, step 7 reduces the correction coefficient LMD by I×Ti whenever this program is executed.

If step 2 determines that the air-fuel ratio is lean with respect to the target air-fuel ratio, processes similar to those for the rich determination are carried out. Namely, step 8 determines whether or not the lean determination is made for the first time. If this is made for the first time, step 9 sets the previous correction coefficient LMD, which has gradually been reduced according to rich determinations, to a minimum value "b". Step 10 adds the proportional constant P to the previous correction coefficient LMD, thereby updating the correction coefficient LMD and increasing the fuel injection quantity Ti. Step 11 sets the flag ADD-P to 1, to indicates that the proportional control has been executed.

If step 8 determines that this is not a first time lean judgement, step 12 multiplies the latest fuel injection quantity Ti by the integration constant I, and adds the multiplication result to the previous correction coefficient LMD, to thereby gradually increase the correction coefficient LMD. When the proportional control of the correction coefficient LMD is carried out for the first time rich or lean determination, labels STRESS and STRESS(B, A) are set. These labels are used for providing an instruction of again learning and correcting the air-fuel ratio of each engine operating region. Here, the label "STRESS" indicates the degree of divergence of the air-fuel ratio.

Figure 8:
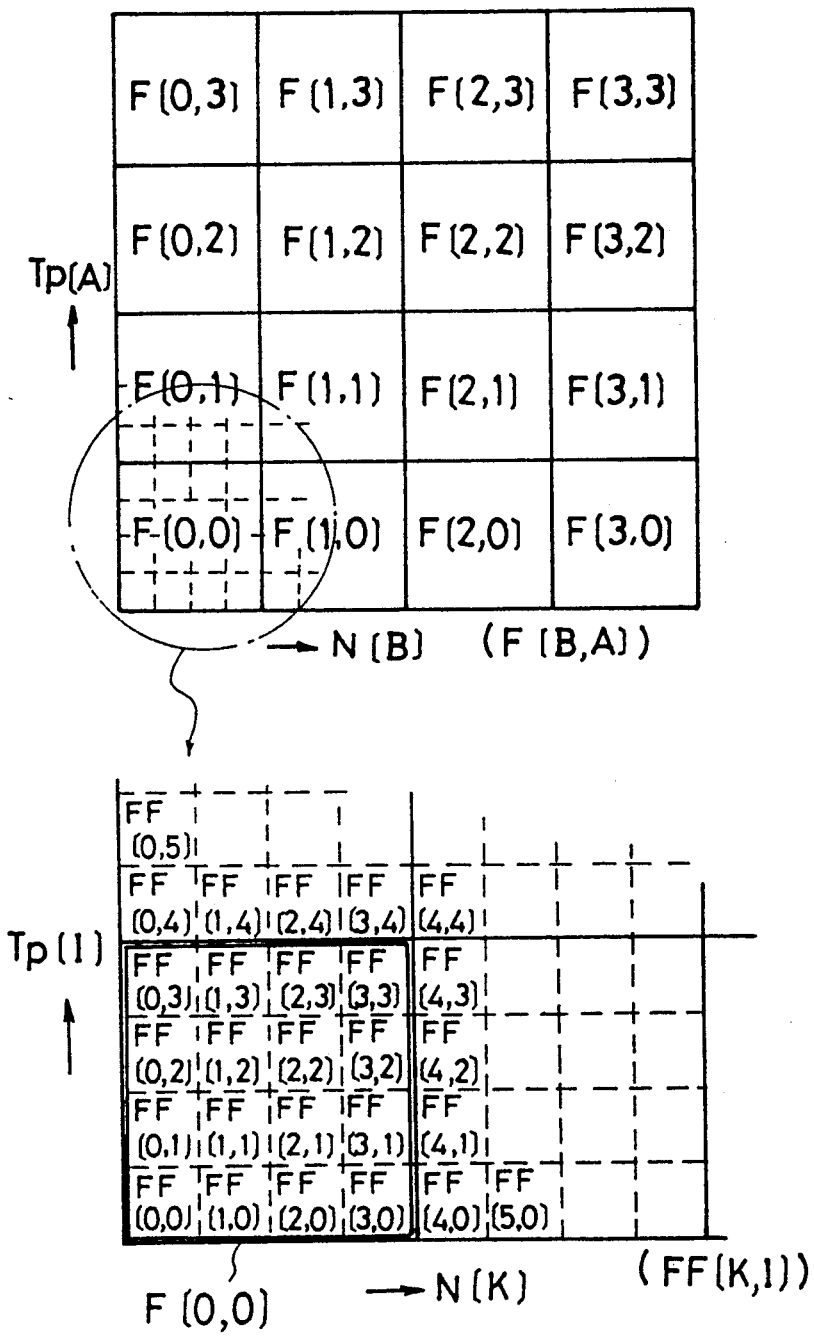
FIG. 8 is a diagram showing learning maps according to the embodiment.

As shown in FIG. 8, this embodiment employs two learning maps of learned air-fuel ratio correction values, for covering an entire engine operating range which is divided into regions according to basic fuel injection quantities Tp and engine rotation speeds N. In one of the learning maps, the entire engine operating range is divided into 16 regions on a 4×4 grid, and in the other of the maps, the entire engine operating range is divided into 256 regions on a 16×16 grid. Namely, each of the 16 regions of the 4×4 grid learning map is subdivided into 16 regions in the 16×16 grid learning map. A learned air-fuel ratio correction value to be applied only to the entire engine operating range is also prepared.

Step 13 checks a flag "flag" which is set to 1 when substantially all learned air-fuel ratio correction values of the respective regions in the 16×16 grid learning map are learned.

If the flag "flag" is 1, i.e., if the learning of the 16×16 grid learning map is substantially completed, step 14 subtracts the initial value 1 of the correction coefficient LMD from an average (a+b)/2 of the maximum and minimum values a and b to be sampled when the rich or lean state is determined to be for the first time, obtains the absolute value of the subtraction results, and finds ΔSTRESS in a map according to the absolute value.

Since the average (a+b)/2 indicates a mean level of the correction coefficient LMD, the parameter for finding the ΔSTRESS is the absolute value of a deviation of the correction coefficient LMD from its initial value. The larger the absolute value of the deviation, the larger the air-fuel ratio diverges from a target value, and thus requires more correction control. When the absolute value of the deviation is close to zero, the ΔSTRESS is zeroed, and when it exceeds a certain level, the ΔSTRESS is gradually increased. The ΔSTRESS indicates the scale of deviation of the correction coefficient LMD with respect to the initial value (reference value).

Once the divided regions in the 16×16 grid learning map are substantially completely learned, the correction coefficient LMD is usually stable around the initial value even if the engine operating condition is changed. If this correction coefficient LMD greatly deviates from the initial value, the ΔSTRESS will have a large value. Step 15 calculates a STRESS which is a cumulative value of the ΔSTRESS. When the STRESS exceeds a predetermined value, it is determined according to the flowchart of FIG. 6 that all results of the learning including the learning of the 4×4 grid learning map are improper, and an instruction to repeat the learning is issued.

Step 16 checks a flag "flag (B, A)" for a corresponding one of the divided regions of the 4×4 grid learning map. This flag is 1 when the learning of substantially all 4×4=16 subdivided regions (part of the 16×16 grid learning map) contained in the corresponding one of the divided regions in the 4×4 grid learning map is completed.

When the flag "flag (B, A)" is 1, step 17 finds ΔSTRESS in a similar manner to step 14, and step 18 calculates a cumulative value of the ΔSTRESS as STRESS (B, A) which is different from the STRESS.

If the STRESS (B, A) exceeds a predetermined value, an instruction is issued according to the flowchart of FIG. 6 to again learn air-fuel ratio correction values stored in one of the regions of the 4×4 grid learning map corresponding to the flag "flag (B, A)" and in the 16×16 grid subdivided regions contained in the 4×4 grid region in question.

Figure 4A:
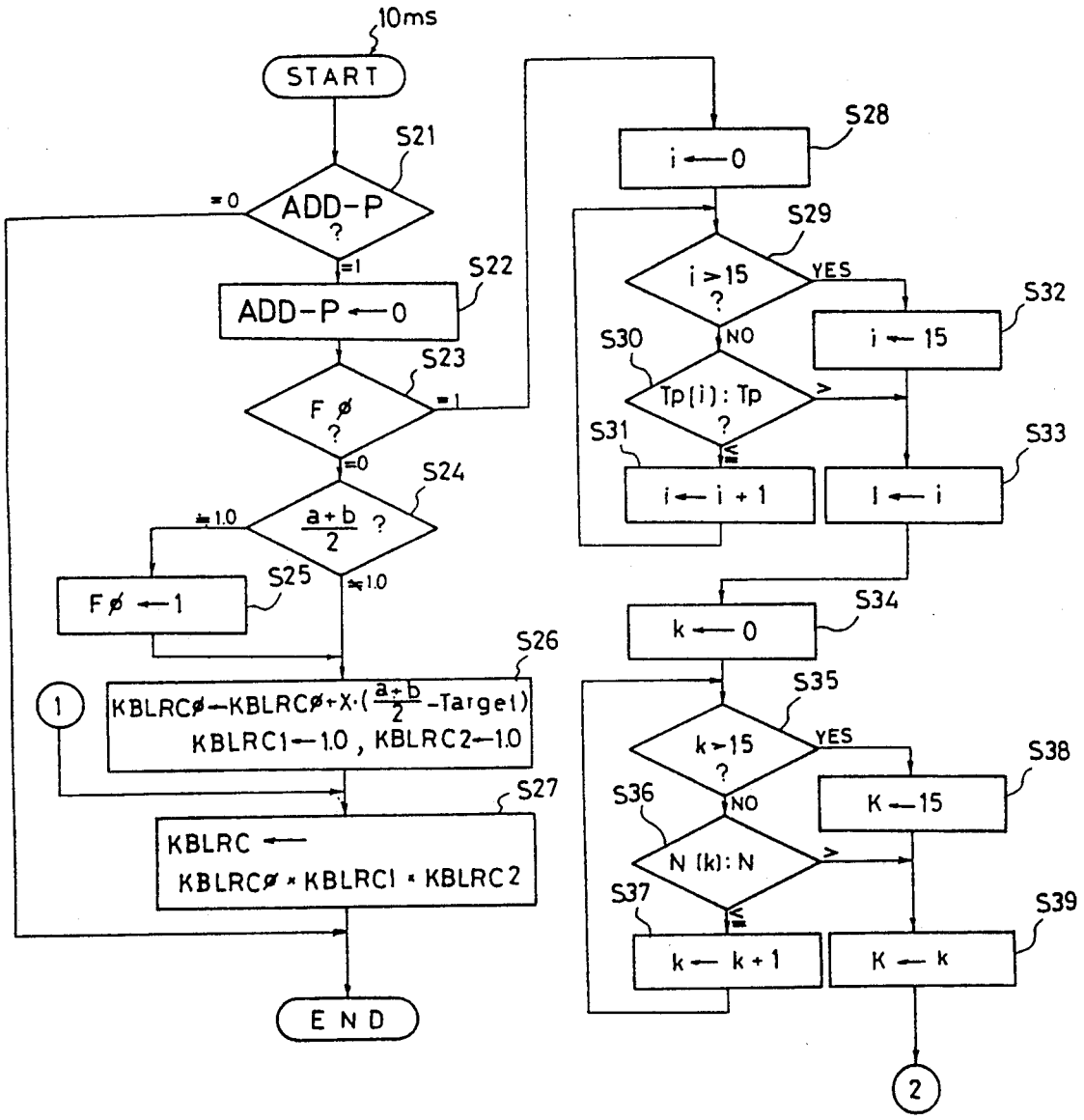
Figure 4B:
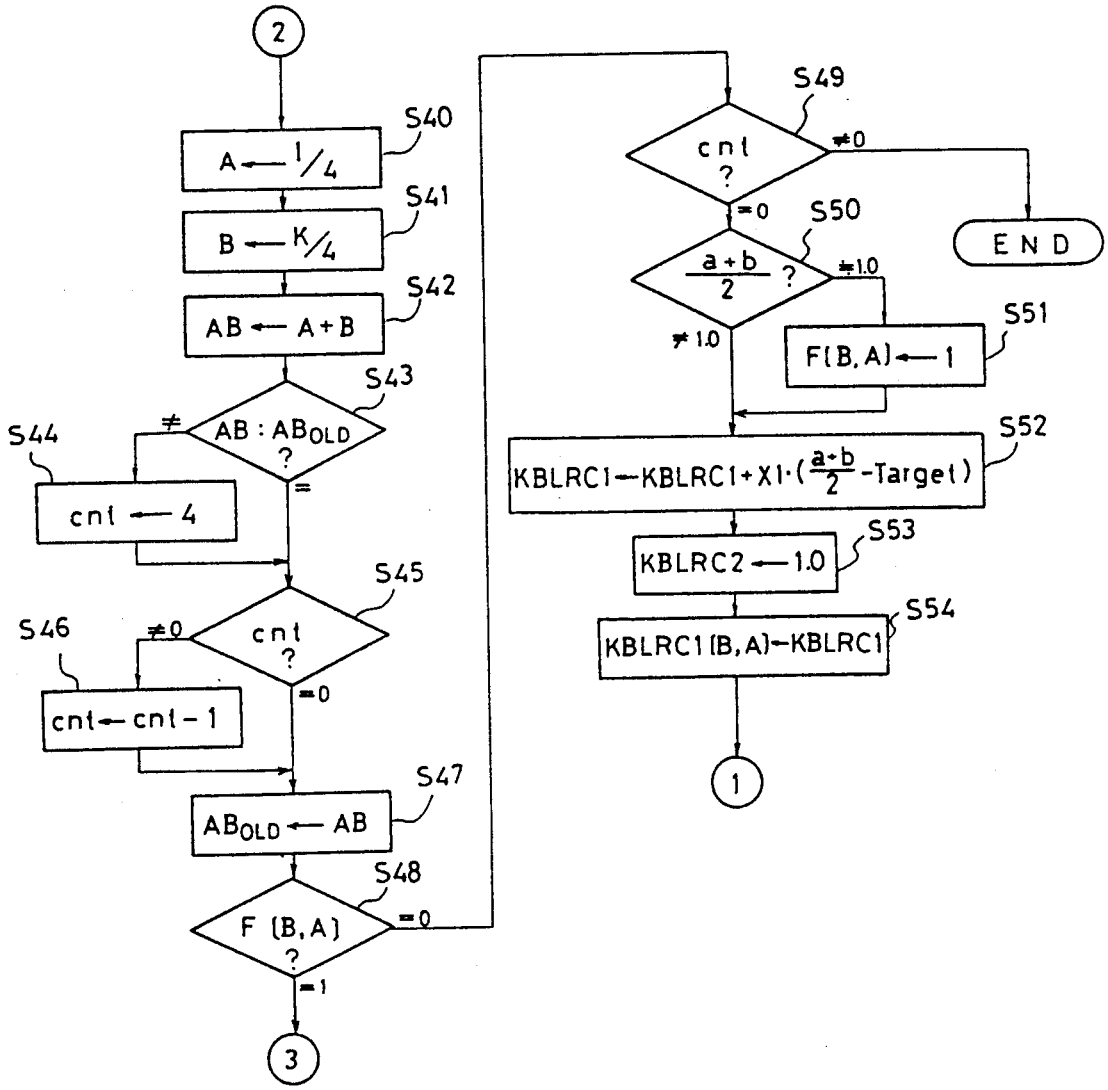
Figure 4C:
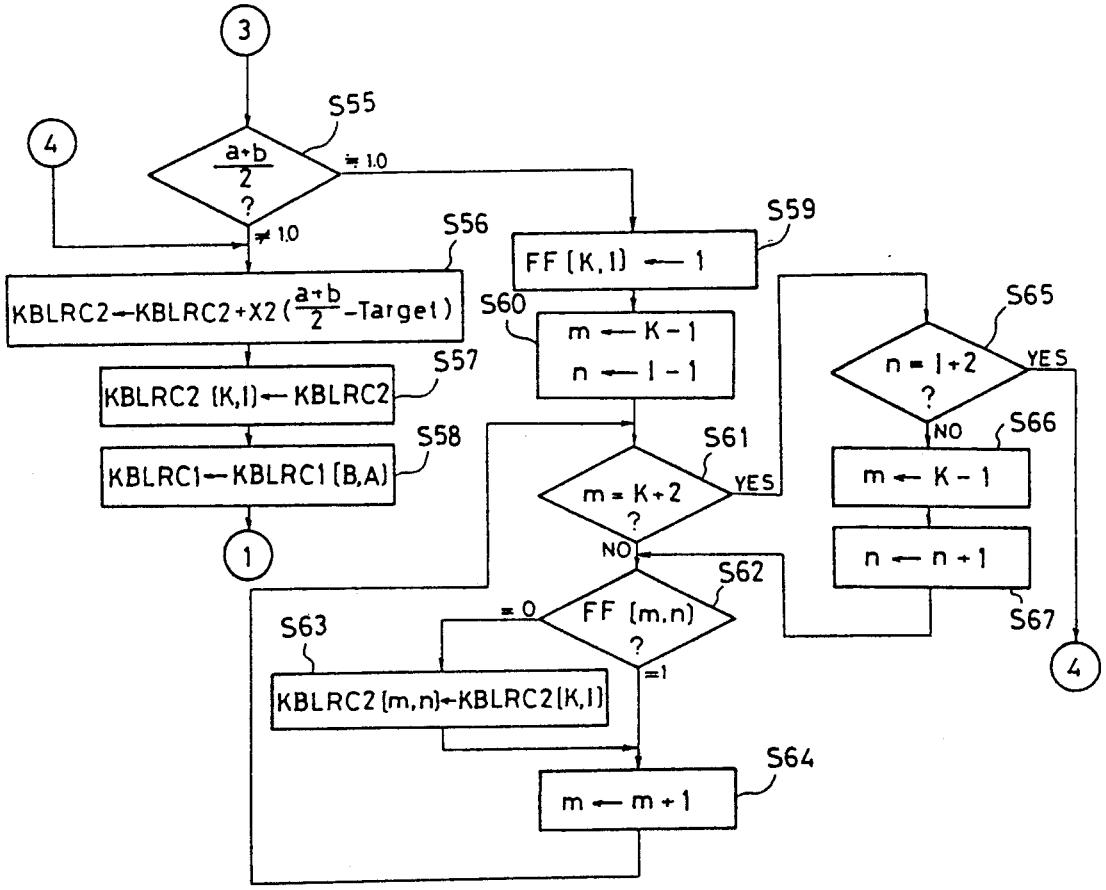

The flowchart of FIG. 4 shows an air-fuel ratio learning program for each region of the engine operating range. This program is executed at very short intervals (for example, 10 ms).

Step 21 checks the flag ADD-P, which is set to 1 when the proportional control of the air-fuel ratio feedback correction coefficient LMD is carried out according to the flowchart of FIG. 3. If the flag ADD-P is 1, step 22 sets the flag ADD-P to 0 to execute the remaining steps of this program. If the flag ADD-P is 0, the program is terminated.

After step 22 zeroes the flag ADD-P, step 23 checks a flag Fϕ which indicates whether or not a correction coefficient KBLRCϕ has been learned. The coefficient KBLRCϕ is common to all regions of the engine operating range and its initial value is 1.

If the flag Fϕ is 0, i.e., if the correction coefficient KBLRCϕ is not learned, step 24 determines whether or not the average (a+b)/2 of the maximum and minimum values a and b of the correction coefficient LMD is approximately 1.

If the average (a+b)/2 is not approximately 1, step 26 subtracts a target of convergence "Target" which is 1.0 in this embodiment from the average (a+b)/2, multiplies the subtraction result by a predetermined coefficient X, adds the multiplication result to a previously learned correction coefficient KBLRCϕ, and sets the addition result as a new learned correction coefficient KBLRCϕ. At the same time, learned correction coefficients KBLRC1 for the 4×4 grid learning map and learned correction coefficients KBLRC2 for the 16×16 grid learning map are set to an initial value 1 each.

$$KBLRC\phi \leftarrow KBLRC\phi + X((a+b)/2 - Target)$$

If step 24 determined that the average (a+b)/2 is approximately 1, step 25 sets the flag Fϕ to 1 to indicate that the learned correction coefficient KBLRCϕ for all regions of the engine operation range has been learned and that the air-fuel ratio feedback correction coefficient LMD has converged substantially to 1 because the learned correction coefficient KBLRCϕ has been learned and set.

In this way, the embodiment starts learning the correction coefficient KBLRCϕ applicable for all regions of the engine operating range, i.e., the widest operating range. Until the learned correction coefficient KBLRCϕ progresses to an extent that the correction coefficient LMD converges substantially to 1, the learned correction coefficients KBLRC1 and KBLRC2 for the divided regions of the engine operating range are each initialized to and kept at 1. Only after the target air-fuel ratio is obtained with the learned correction coefficient KBLRCϕ alone, the learning of the divided regions of the engine operating range is started.

Step 27 multiples the learned correction coefficient KBLRCϕ for the entire engine operating range and the learned correction coefficient KBLRC1 and KBLRC2 for the 4×4 grid regions and 16×16 grid subdivided regions by one another, and sets the multiplication result as a final learned correction coefficient KBLRC.

$$KBLRC \leftarrow KBLRC\phi \times KBLRC1 \times KBLRC2$$

After step 26, KBLRC=KBLRCϕ. If the air-fuel ratio feedback correction coefficient LMD is not stabilized at around its initial value with the learned correction coefficient KBLRCϕ, the flag Fϕ will be continuously 0, and the process of step 26 repeated.

If the step 23 determines that the flag Fϕ is 1, it is understood that the correction coefficient KBLRCϕ for the entire engine operating range has been learned, and the air-fuel ratio learning process on each of the divided regions of the engine operating range is started.

Step 28 sets a count value "i" to 0. The count value i used is for telling to which of the 16 grid regions the present basic fuel injection quantity (basic fuel supply quantity) Tp belongs. Step 29 determines whether or not the count value i is over 15, and if it is not over 15, step 30 compares a basic fuel injection quantity threshold Tp(i) for the count value i with the present basic fuel injection quantity Tp.

If step 30 determines that the basic fuel injection quantity Tp is smaller than the threshold value Tp(i), step 33 sets the count value i of this time as a value I that indicates one of the grid regions to which the present basic fuel injection quantity Tp belongs.

Namely, a maximum basic fuel injection quantity for each range is preset as a threshold value Tp(i), and the present basic fuel injection quantity Tp is sequentially compared with the threshold values Tp(i) in ascending order, and when it becomes Tp(i)>Tp for the first time, the i of this time is set as the I for indicating the number of the region for the quantity Tp.

If step 30 determines that Tp(i) is equal to or larger than Tp, step 31 increases the count value i by one so that the present Tp may be compared with a one-rank larger Tp(i).

If step 31 increases the count value i to 16, it is understood that the present basic fuel injection quantity Tp is larger than the maximum one of the initially set basic injection quantities Tp distributed in the 16 grid regions (blocks) numbered from 0 through 15. In this case, step 32 sets the count value i to the maximum region number of 15, and step 33 is executed with the present basic fuel injection quantity Tp assumed to belong to the region involving the maximum of the initially set basic fuel injection quantities Tp.

Next, the engine rotation speed N is related to one of the 16 grid regions (blocks) by determining the number of the region to which the present engine rotation speed N belongs according to a count value "k", in a manner similar to that for the basic fuel injection quantity Tp. First, step 34 initializes the count value k to 0, and until the count value k exceeds 15, step 36 sequentially compares the present engine rotation speed N with each threshold value N(k). When it becomes N(k)>N for the first time, step 39 sets the count value k of this time as a number "k" for indicating the number of a region to which the present engine rotation speeds N belongs. If N(k)<N, step 37 increases the count value k by 1.

In this way, with the basic fuel injection quantity Tp and engine rotation speed N serving as parameters, the position of the present operating condition is identified in the learning map of 16×16=256 regions, and the position is expresses with coordinates (K, I) where I represents a region number of the basic fuel injection quantity Tp and K a region number of the engine rotation speed N.

Since each of the 4×4 grid regions involves 4×4=16 subdivided regions in the 16×16 grid learning map as shown in FIG. 8, the present engine operating condition can be identified on the 4×4 grid learning map according to the coordinates I and K once the position of the present engine condition is determined in the 16×16 grid learning map with the coordinates I and I as mentioned above.

Namely, step 40 divides the region number I for the basic fuel injection quantity Tp by 4, discards fractions of the division result, and sets the resultant integer as "A". Step 41 divides the region number K for the engine rotation speed N by 4, discards fractions of the division result, the position of the present operating condition is expresses with coordinates (A, B) in the 4×4 grid learning map.

Step 42 adds the integers A and B to each other to find an addition result "AB". Step 43 compares a previous value ABOLD with the present value AB to determine whether or not the present engine operating range is the same as before. If AB is not equal to the previous ABOLD, to indicate the present operating range differs from the previous operating range in the 4×4 grid learning map, step 44 sets a count value "cnt" to a predetermined value (for example, 4).

Step 45 determines whether or not the count value "cnt" is 0. If it is not 0, step 46 decreases the count value "cnt" by one. As long as the engine operating condition is not stationary in a particular operating range in the 4×4 grid learning map, the count value "cnt" will not be counted down to zero.

Step 47 sets the AB found in step 42 to ABOLD, which is used in step 43 for the next determination.

Step 48 checks a flag F (B, A) which indicates whether or not the region (B, A) of the 4×4 grid learning map to which the present engine operating condition belongs has been learned. When the flag F (B, A) is 0, i.e., when the region in question is not learned, step 49 is executed.

Step 49 determines whether or not the count value "cnt" is zero, if it is not zero, i.e., if the engine operating condition fluctuates in the 4×4 grid learning map, the program is terminated. Only when the count value "cnt" is zero, i.e., only when the engine operating condition is stable in one region in the 4×4 grid learning map, is step 50 executed.

Step 50 determines the progress of the learning according to whether or not the average of the maximum and minimum values a and b, i.e., the center value of the air-fuel ratio feedback correction coefficient LMD sampled in the flowchart of FIG. 3 is around its initial value (=1). If it is not substantially 1, i.e., if the learning is not completed, step 52 is executed.

Step 52 subtracts the target of convergence "Target" (1 0 in this embodiment) from the average of the maximum and minimum values a and b, multiplies the subtraction result by a predetermined coeffient X1, adds the multiplication result to a learned correction coefficient KBLRC1 stored in the region (B, A) of the 4×4 grid learning map, and sets the addition results as a new learning coefficient KBLRC1 for the region (B, A).

$$KBLRC1 \leftarrow -KBLRC1 + X1((a+b)/2 - Target)$$

If step 50 determines that the average (a+b)/2 is nearly 1, it is understood that the learning in the present region of the 4×4 grid learning map is completed. In this case, step 51 sets the flag F (B, A) to 1 to indicates that the region represented by the flag F (B, A) has been learned.

During the learning of the region on the 4×4 grid learning map, learned correction coefficients KBLRC2 for the regions of the 16×16 grid learning map are set to an initial value of 1 each in step 53, and step 54 rewrites a learned correction coefficient KBLRC1 (B, A) for the region in question of the 4×4 grid learning map with the latest correction coefficient KBLRC1 learned in step 52.

In this way, when there is a not learned in any region of the 4×4 grid learning map, a predetermined portion of the deviation of the average (a+b)/2 from the target value "Target" is added to the learned correction coefficient KBLRC1 to update the same, when the operating condition is stable in the region in question. As a result, the target air-fuel ratio can be obtained according to corrections made to the learned correction coefficient KBLRC1 and KBLRCϕ instead of the air-fuel ratio feedback correction coefficient LMD. When the air-fuel ratio feedback correction coefficient LMD converges substantially to the initial value of 1, it is understood that the learning is complete.

After step 54 rewrites the map data, step 27 multiplies the learned correction coefficient KBLRCϕ common for the entire operating range of the engine, the learned correction coefficient KBLRC1 calculated in step 52 for the 4×4 grid learning map, and the learned correction coefficient KBLRC2 initialized in step 53 for the 16×16 grid learning map by one another, thereby setting a final learned correction coefficient KBLRC.

When step 48 determines that the flag F (B, A) is 1, i.e., if the corresponding region (B, A) of the 4×4 grid learning map stores a learned correction coefficient KBLRC1, the learning is carried out for the 16 subdivided regions which are part of the 16×16 grid learning map and contained in the region (B, A) which is storing the learning correction coefficient KBLRC1.

Step 55 determines whether or not the average (a+b)/2 is approximately 1. If the average (a+b)/2 is not approximately 1, i.e., if it is an unlearned state which must be corrected according to the air-fuel ratio feedback correction coefficient LMD, step 56 subtracts the target of convergence "Target" (1.0 in this embodiment) from the average (a+b)/2, multiplies the subtraction result by a predetermined coefficient X2, adds the multiplication result to a stored learned correction coefficient KBLRC2 corresponding to the present engine operating condition in the 16×16 grid learning map, and sets the addition result as a new learned correction coefficient KBLRC2 for the corresponding region.

$$KBLRC2 \leftarrow KBLRC2 + X2((a+b)/2 - Target)$$

Step 57 sets the learned correction coefficient KBLRC2 calculated and updated in step 56 as data for the corresponding region (K, I) of the 16×16 grid learning map to which the present engine operating condition belongs, thereby rewriting the map data.

Step 58 reads a learned correction coefficient KBLRC1 (B, A) out of the region (B, A) of the 4×4 grid learning map to which the present operating condition belongs, and sets the same as a learned correction coefficient KBLRC1 for the 4×4 grid learning map.

After step 58 rewrites the map data, step 27 multiplies the learned correction coefficient KBLRCϕ common to the entire operating range of the engine, the learned correction coefficient KBLRC2 calculated and updated in step 56 for the 16×16 grid learning map, and the learned correction coefficient KBLRC1 retrieved in step 58 from the 4×4 grid learning map, by one another, to thereby set a final learned correction coefficient KBLRC. Namely, when it is necessary to learn a region of the 16×16 grid learning map, the correction coefficient KBLRCϕ for the entire operating range of the engine and the corresponding region of the 4×4 grid learning map are already learned, so that the learned correction coefficient KBLRCϕ and learned correction coefficient KBLRC1 are fixed when learning the correction coefficient KBLRC2.

As a result of the updating of the learned correction coefficient KBLRC2 in step 56, step 55 may detect that the correction coefficient LMD is stabilized around the initial value of 1.0, which is the target of the convergence. Then, step 59 sets a flag FF (K, I) to 1 to indicate that the region (K, I) of the 16×16 grid learning map to which the present engine operating condition belongs has been completely learned. If there are any unlearned regions in the vicinity of the region (K, I) of the 16×16 grid learning map (FIG. 9), the learned correction coefficient KBLRC2 stored in the region (K, I) is stored in each of the unlearned regions.

Step 60 subtracts 1, from each of the coordinates (K, I) indicating the region of the 16×16 grid learning map to which the present engine operating condition belongs, and sets the subtraction results to m and n, respectively. Step 61 determines whether or not m=K+2.

When the process proceeds from step 60 to step 61, step 61 provides a result of NO, so that step 62 determines whether a flag FF (m, n) is 1 or 0 to see if the region (m, n) of the 16×16 grid learning map is already learned.

If the flag FF (m, n) is 0, i.e., if the region is not learned, step 63 stores the learned correction coefficient KBLRC2 (K, I) of the region (K, I) as a correction coefficient KBLRC2 (m, n) of the region (m, n).

Step 64 increase m by one and returns to step 61. This is repeated until m=K+2 is established. Namely, n is fixed, and m is changed in a range of ±1 around K to determine whether or not the region indicated with the n and changed m is already learned. If m=K+2 is established due to the increase of m by one in step 64, step 65 determines whether or not n=I+2. If n is not equal to I+2, step 66 sets m to K−1 again, and step 67 increases n by one. Thereafter, step 62 is carried out.

At first, m is changed in a range of ±1 around K with n=I−1, to check the adjacent regions. Thereafter, m is changed in a range of ±1 around K with n=I, and then m is changed in a range of ±1 around K with n=I+1. If eight adjacent regions (FIG. 9) around (K, I) are unlearned, the learned correction coefficient KBLRC2(k, I) is stored as a learned correction coefficient KBLRC2 (m, n) in each of the adjacent unlearned regions.

In this way, a learned result of a learned region is applied to adjacent unlearned regions. Even if the ability to learn the subdivided regions on the 16×16 grid learning map is small, correction values stored in unlearned regions can be substantially optimized, thereby preventing a stepwise control of an air-fuel ratio between the regions of the engine operating range.

If step 65 determines n=I+2, i.e., if the eight regions around the region (K, I) are completely processed, step 56 updates the learned correction coefficient KBLRC2 as well as data for the 16×16 grid learning map, and reads the learned correction coefficient KBLRC1 out of the 4×4 grid learning map. Step 27 then sets a final learned correction coefficient KBLRC.

In this way, according to this embodiment, the correction coefficient for the entire engine operating range is first learned, and thereafter, one of the regions on the 4×4 qrid learning map is learned. Any region of the 4×4 grid learning map already learned is subdivided into 4×4 grid regions and learned. Namely, the learning is carried out from large regions to small regions. The learning of the large regions can securely converge the learning of an air-fuel ratio, and the learning of the subdivided regions can precisely deal with differences in required correction values of the regions of the engine operating range.

Figure 5:
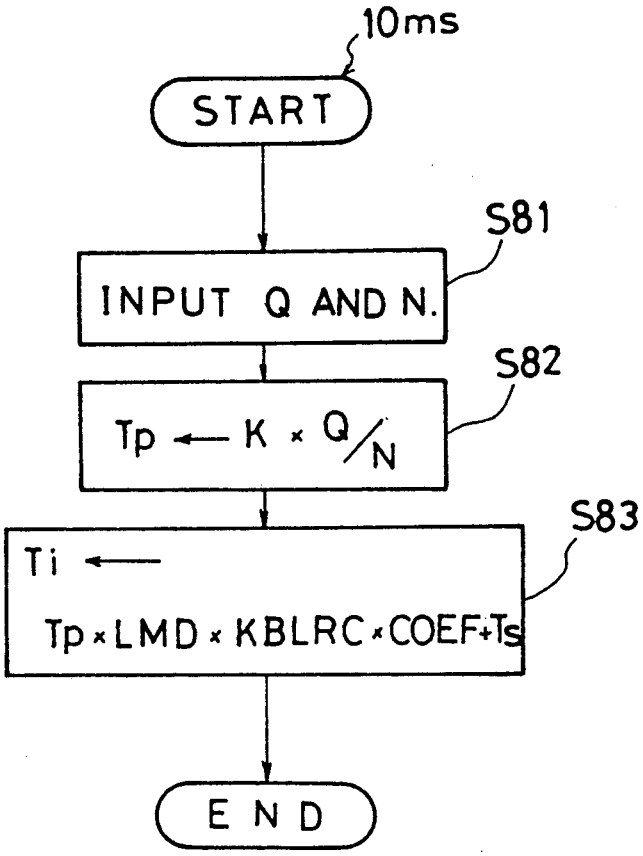
Figure 9:
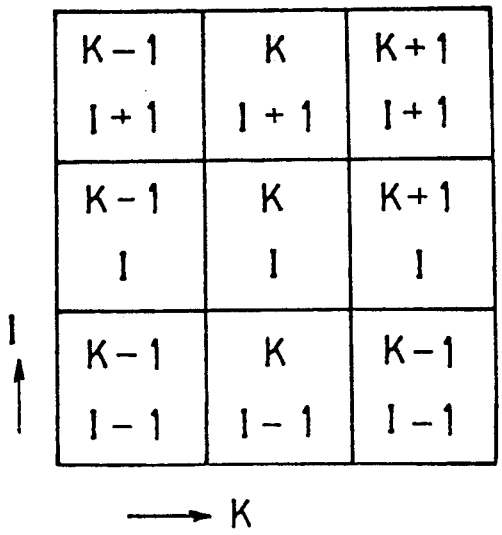
FIG. 9 is a diagram showing part of the maps and explaining an estimation learning process according to the embodiment.

The learned correction coefficient KBLRC set by step 27 is used for calculating a fuel injection quantity Ti in the program of the flowchart of FIG. 5.

The program of the flowchart of FIG. 5 is executed at predetermined short intervals (for example, 10 ms). Step 81 receives an intake airflow quantity Q detected by the airflow meter 13 and an engine rotation speed N calculated according to signals from the crank angle sensor 14.

According to the intake airflow quantity Q and engine rotation speed N received in step 81, step 82 calculates a basic fuel injection quantity Tp (←K×Q/N where K is a constant) corresponding to and intake airflow quantity for unit rotation.

Step 83 corrects the basic fuel injection quantity Tp calculated in step 82, and computes a final fuel injection quantity (fuel supply quantity) Ti. Correction values for correcting the basic fuel injection quantity Tp are the correction coefficient KBLRC learned and set according to the flowchart of FIG. 4, the air-fuel ratio feedback correction coefficient LMD calculated according to the flowchart of FIG. 3, a correction coefficient COEF based on a basic correction coefficient according to the cooling water temperature Tw detected by the water temperature sensor 15, and a coefficient for correcting a quantity increase after the start of the engine, and a correction component Ts for correcting a change in an effective injection period of the fuel injection valve 6 due to a change in a battery voltage. The final fuel injection quantity Ti is updated at a predetermined interval.

$$Ti \leftarrow Tp \times LMC \times KBLRC \times COEF + Ts$$

At a predetermined fuel injection timing, the control unit 12 provides the fuel injection valve 6 with a driving pulse signal having a pulse width which corresponds to the calculated fuel injection quantity Ti, to thereby control the quantity of fuel to be supplied to the engine 1.

Figure 6:
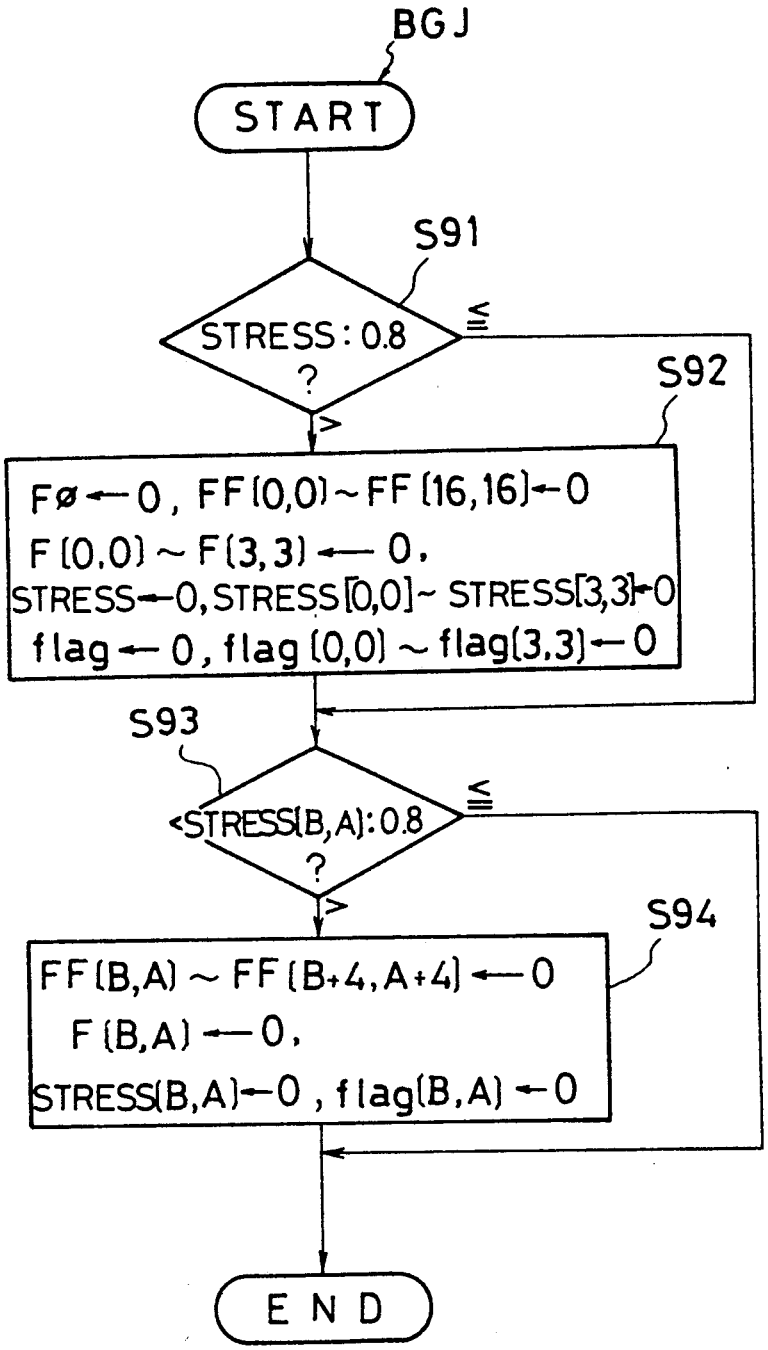

The program of the flowchart of FIG. 6 carrier out a process according to the STRESS and STRESS (B,A) sampled in the flowchart of FIG. 3. This process is carried out as a background job (BGJ).

Step 91 compares the STRESS (a divergence of air-fuel ratio) with a predetermined value (for example, 0.8) to determine whether or not the divergence of air-fuel ratio is over the predetermined value when the learning is nearly completed. The STRESS is found when most of the regions of the 16×16 grid learning map are learned and the flag "flag" is set to 1. (The setting of the flag "flag" will be explained in detail with reference to the flowchart of FIG. 7.)

When the STRESS is over the predetermined value, it is determined that the nearly completed learning is improper and will cause a divergence of the air-fuel ratio, and thus the process proceeds to step 92 to repeat the learning.

Step 92 resets (zeroes) the flags F $\phi$, F(0, 0) to F(3, 3), and FF(0, 0) to FF(16, 16) for indicating the air-fuel ratio learning states of the respective regions. Step 92 also resets (zeroes) the flag "flag" which is set to 1 when all regions of the 16×16 grid learning map are learned, and the flags "flag (0,0)" to "flag (3, 3)" each of which is set to 1 when the learning is completed of almost all the 16 subdivided regions of the 16×16 grid learning map included in a corresponding one of 16 regions of the 4×4 grid learning map.

Since the learning is repeated from the entire engine operating range, STRESS and STRESS (0, 0) to STRESS (3, 3) are also reset (zeroed).

Step 93 determines whether or not STRESS (B, A) corresponding to one of the regions of the 4×4 grid learning map to which the present engine operating condition belongs is over a predetermined value (for example, 0.8).

If the STRESS (B, A) is over the predetermined value, i.e., if the learning of the region in question of the 4×4 grid learning map is improper, step 94 repeats the learning of the region in question.

To repeat the learning of the 16 regions of the 16×16 grid learning map included in the region of the 4×4 grid learning map corresponding to the present engine operating condition, step 94 resets (zeroes) the flags FF (B, A) to FF (B+4, A+4) indicating whether or not the 16 regions are learned, and a flag F (B, A) for the region in question of the 4×4 grid learning map, so that the region indicated with present coordinates (B, A) of the 4×4 grid learning map and the 16 subdivided regions contained in the region (B, A) may be again learned.

In this way, the region indicated with the present coordinates (B, A) is again learned by resetting (zeroing) the STRESS (B, A) and flag "flag (B, A)," and STRESS for the present region (B, A) is sampled again from the initial value.

In this way, when the scale of a deviation (stress) of the fir-fuel ratio feedback correction coefficient LMD from the reference value (target of convergence) exceeds the predetermined value, the learning is repeated. When the basic air-fuel ratio suddenly changes due to an accident such as a hole formed in air inlet system of the engine, the learning is repeated from the larger regions, thereby quickly converging the air-fuel ratio.

Figure 7A:
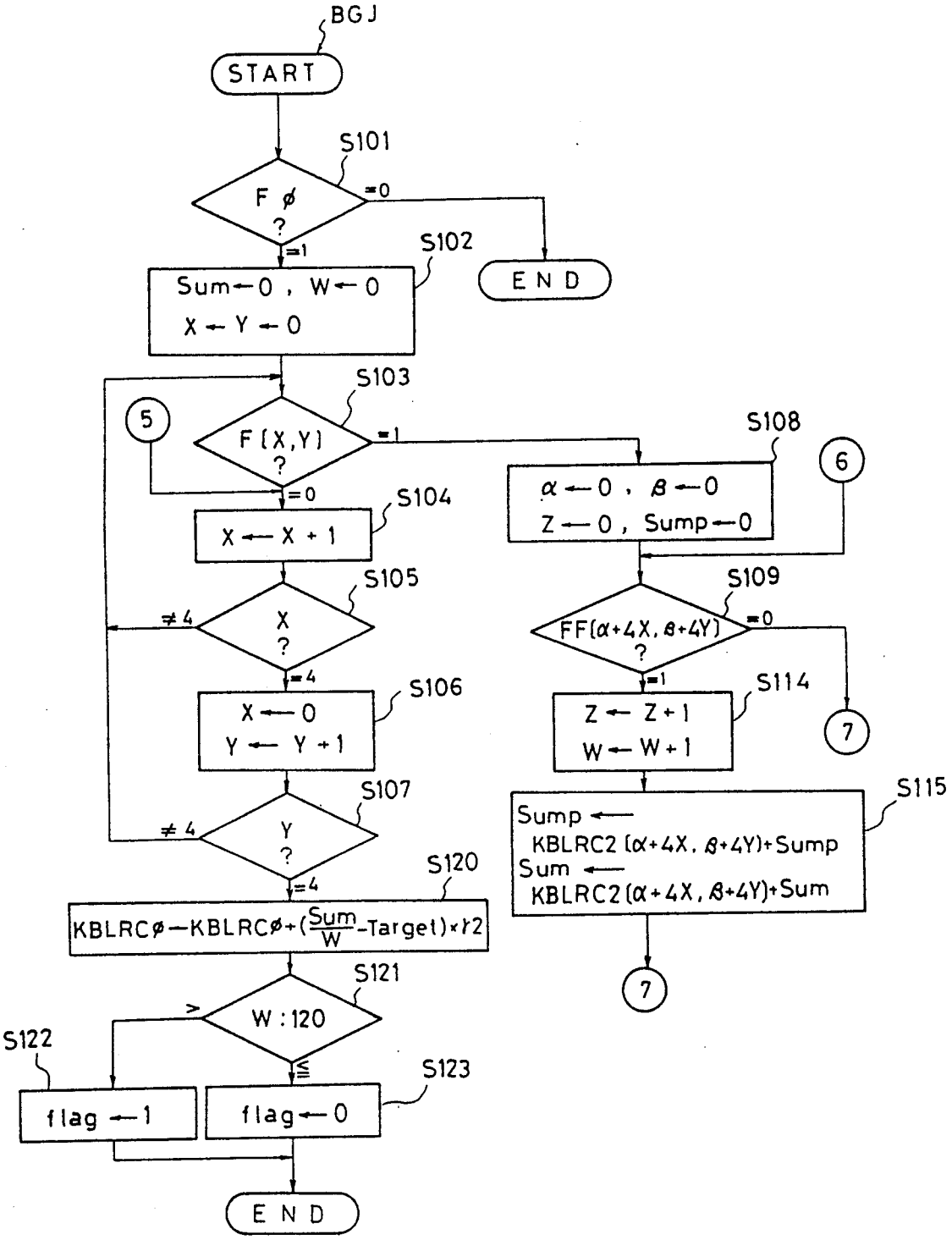
Figure 7B:
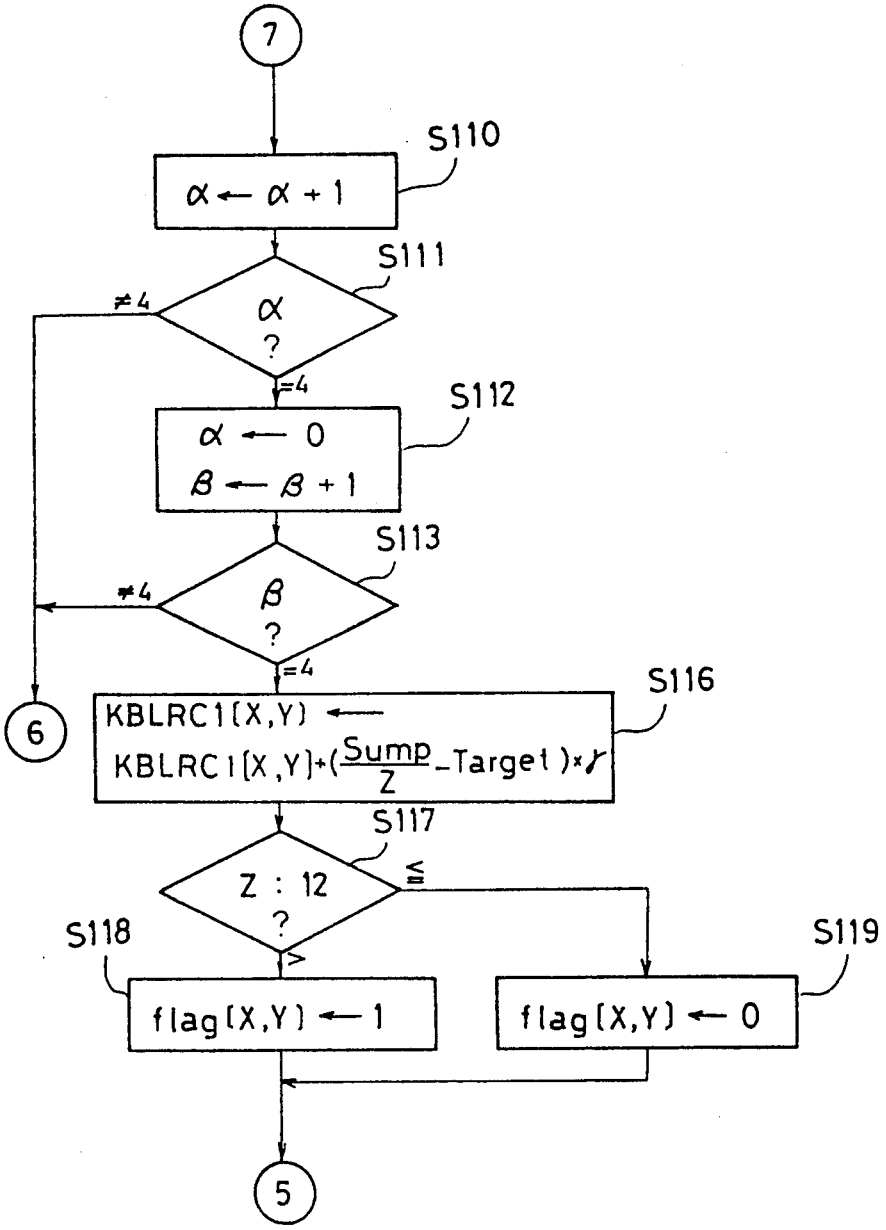

FIG. 7 is a flowchart showing a program for correcting the learned correction coefficient of one of the large regions based on subdivided regions.

The program of the flowchart of FIG. 7 is executed as a background job (BGJ). Step 101 checks the flab F$\phi$, which is set to 1 when the learned correction coefficient KBLRC$\phi$ for the entire engine operating range has been learned. If the flag F$\phi$ is 0, this program is terminated, and when it is 1, the process proceeds to step 102.

Step 102 resets (zeroes) various parameters to be used in this program. Step 103 checks a flag F (X, Y) having coordinates X and Y which have been reset in the step 102. This flag F (X, Y) indicates a learning state of the 4×4 grid learning map. Namely, step 103 finds learned regions of the 4×4 grid learning map. The X and Y are each 0 at first, and when a region 0, 0) is unlearned, step 104 increases X by one to (1, 0). Step 105 determines that X is not 4, and therefore, step 103 is repeated. When X reaches 4 due to the increment of 1 in step 104, step 106 resets (zeroes) X, and thereafter, Y is increased by one. Until step 107 determines that Y is 4, the process returns to step 103, and step 104 again increases Y by one. Namely, X is changed with the fixed Y, thereby determining the flags F (X, Y) of the respective regions.

If any one of the flags F (X, Y) corresponding to one of the regions of the 4×4 grid learning map is 1, i.e., if the region in question is learned, the process proceeds to step 108, which resets (zeroes) $\alpha$ and $\beta$ for checking the flags FF (0, 0) to FF (16, 16) for the regions of the 16×16 grid learning map as well as other parameters.

Similar to the determination of the flags F (X, Y) of the 4×4 grid learning map, step 109 checks the flags FF (4X, 4Y) to FF (4X+4, 4Y+4) of the 16 regions of the 16×16 grid learning map included in the region in question which has been determined to have been learned of the 4×4 grid learning map. The variables $\alpha$ and $\beta$ are processed in steps 110 to 113 in the same manner as in the steps 104 to 107.

If there is a region with a flag FF of 1 among the regions of the 16×16 grid learning map included in the region (X, Y) of the 4×4 grid learning map, step 114 is executed. Step 114 increases Z and W each by one. The Z and W are used for counting up the sampling numbers of learned correction coefficients. The Z is reset (zeroed) in step 108 whenever there is a learned region on the 4×4 grid learning map, and therefore, indicates the number of regions of the 16×16 grid learning map included in one of the regions of the 4×4 grid learning map. The W is reset in step 102, and therefore, indicates the number of learned regions of the 16×16 grid learning map included in the region (X, Y) of the 4×4 grid learning map.

Step 114 increases the count values Z and W by one each, and step 115 finds a cumulative value of the learned correction coefficients KBLR2 stored in the regions of the 16×16 grid learning map which have been determined to have been learned, as follows:

$$\text{Sump} \leftarrow \text{KBLRC2}\ (\alpha+4x,\ \beta+4Y)+\text{Sump}$$

$$\text{Sum} \leftarrow \text{KBLRC2}\ (\alpha+4x,\ \beta+4Y)+\text{Sum}$$

Here, the Sum is reset (zeroed) similar to W at the start of this program, so that it is the cumulative value of the learned correction coefficients KBLRC2 of the learned regions of the 16×16 grid learning map. Sump is reset (zeroed) in step 108 whenever a learned region is found of the 4×4 grid learning map, the cumulative value of the learned correction coefficients KBLRC2 of the regions of the 16×16 grid learning map are included in the learned region of the 4×4 grid.

In this way, a learned region is found of the 4×4 grid learning map, and learned correction coefficients KBLRC2 are sampled from learned regions of the 16×16 grid learning map included in the found learned region. Thereafter, step 113 proceeds to step 116.

Step 116 subtracts the target of convergence "Target" (1.0 in this embodiment) from an average value Sump/z of the learned correction coefficients KBLRC2 of the regions of the 16×16 grid learning map included in the region (X, Y), multiplies the subtraction result by a predetermined coefficient $\gamma$, adds the multiplication result to a learned correction coefficient KBLRC1 (X, Y) stored in the learned region of the 4×4 grid learning map, and sets the addition result as a KBLRC1 (X, Y).

$$\text{KBLRC1}\ (X, Y) \leftarrow \text{KBLRC1}\ (X, Y)+(\text{Sump}/z-\text{Target})\times\gamma$$

Namely, the learned correction coefficient KBLRC1 (X, Y) of the region of the 4×4 grid learning map is updated according to the average of the learned correction coefficients KBLRC2 of the 16 subdivided regions included in the region in question of the 4×4 grid learning map.

Step 117 determines whether or not the sampling number z (16 at maximum) of the cumulative value Sump of the learned correction coefficients KBLRC2 used in step 116 is over a predetermined value (for example, 12), thereby determining whether or not the learning is sufficient of the 16 subdivided regions of the 16×16 grid learning map included in the region (X, Y) of the 4×4 grid learning map.

If the z is over the predetermined value, step 118 sets a flag "flag (X, Y)" to 1 to indicate that the learning of the subdivided regions in the region (X, Y) is sufficient. If the z is below the predetermined value, step 119 sets the flag "flag (X, Y)" to 0 to indicate that the learning of the subdivided regions in the region (X, Y) is not sufficient. The flag "flag (X, Y)" is checked by the flowchart of FIG. 3 to find the STRESS (the scale of a divergence of the air-fuel ratio).

In this way, if there is a learned region (X, Y) of the 4×4 grid learning map, learned regions of the 16×16 grid learning map contained in the region (X, Y) are sampled, and the learned correction coefficient KBLRC1 of the region (X, Y) is updated according to an average of the learned correction coefficients KBLRC2 of the learned regions of the 16×16 grid learning map. After this process is made for all regions of the 4×4 grid learning map, step 107 proceeds to step 120.

Step 120 updates the learned correction coefficient KBLRC$\phi$ for the entire enginw operating range as follows:

$$\text{KBLRC}\phi \leftarrow \text{KBLRC}\phi+(\text{Sum}/W-\text{Target})\times\gamma 2$$

where Sum is the cumulative value of the learned correction coefficients KBLRC2 of the regions of the 16×16 grid learning map, and W the sampling number of the learned correction coefficients KBLRC2. Sum/W is, therefore, and average of the learned correction coefficients KBLRC2 of the 16×16 grid learning map. A deviation of the average from the target value "Target" is multiplied by a predetermined coefficient $\gamma 2$, the multiplication result is added to the learned correction coefficient KBLRC$\phi$, and the addition result is set as a new correction coefficient KBLRC$\phi$ for the entire engine operating range.

After step 120 updates the correction coefficient KBLRC$\phi$, step 121 determines whether or not the W (maximum 256) representing the number of learned regions of the 16×16 grid learning map is over a predetermined value (for example, 120).

If the W is over the predetermined value, it is understood that all the regions of the 16×16 grid learning map are nearly learned and that the entire engine operating range, the regions of the 4×4 grid learning map, and the regions of the 16×16 grid learning map are sufficiently learned. Step 122 sets, therefore, the flag "flag" to 1. If the W is not over the predetermined value, step 123 sets the flag "flag" to 0 to indicate that the regions of the regions of the 16×16 grid learning map are not sufficiently learned.

The flag "flag" set in step 122 or 123 is checked in step 13 of the flowchart of FIG. 3.

As mentioned above, according to an average of learned correction coefficients stored in subdivided regions of the 16×16 grid learning map, learned correction coefficients stored in regions of the 4×4 grid learning map involving the subdivided regions are updated. Accordingly, and air-fuel ratio divergence which occurs slowly in a long range of time and is difficult to identify from the STRESS and STRESS (B, A) can be detected to update the learned correction coefficients.

If the learning is frequently repeated according to the STRESS and STRESS (B, A), the learning does not converge quickly, so that it is preferable to repeat the learning only when there is a relatively large change in an airfuel ratio. This, however, causes learned values of the 16×16 grid learning map to gradually change when the air-fuel ratio diverges slowly over a long time, so that learned correction coefficients for the 4×4 grid learning map and for the entire engine operating range may be improper. To deal with this, changes in the learned correction coefficients KBLRC2 of the 16×16 grid learning map are used to update the learned correction coefficients for the 4×4 grid learning map and for the entire engine operating range.

As this embodiment employs the airflow meter 13, the basic fuel injection quantity Tp may be set according to a negative suction pressure and an engine rotation speed N, or according to a throttle valve opening and the engine rotation speed N.

The embodiment employs the two learning maps in which an engine operating range is divided into regions according to basic fuel injection quantities Tp and engine rotation speeds N, but the numbers of maps and grids are not limited to those shown in the embodiment, and an engine operating range may be divided into regions according to not only the basic fuel injection quantities Tp but also Q/N and negative suction pressure, etc.

Capability Of Exploitation In Industry

As explained above, the method of and apparatus for learning and controlling the air-fuel ratio of an internal combustion engine according to the invention improves the convergence of learning and the correction accuracy of each engine operating region, so that the invention is most suitable for controlling the air-fuel ratio of an electronically controlled fuel injection type internal combustion gasoline engine. The invention is remarkably effective for improving the quality and performance of the internal combustion engine.

I claim:

1. A method of learning and controlling the air-fuel ratio of an internal combustion engine comprising the steps of dividing the operating range of the internal combustion engine into regions of different sizes; preparing a plurality of learning maps for storing learned air-fuel ratio correction values for the divided regions, respectively, the stored correction values being able to be rewritten; setting a basic fuel supply quantity according to engine operating condition involving at least a parameter related to the quantity of air drawn into the engine; comparing a detected air-fuel ratio of a mixture of gases drawn into the engine with a target air-fuel ratio to set an air-fuel ratio feedback correction value for correcting the basic fuel supply quantity to bring an actual air-fuel ratio close to the target air-fuel ratio; learning a deviation of the air-fuel ratio feedback correction value from a reference value; updating the learned air-fuel ratio correction values of the divided regions of the engine operating range in descending order of the sizes of the devided regions on the learning maps such that the deviation is reduced; and supplying fuel to the engine according to a fuel supply quantity finally set according to the basic fuel supply quantity, the air-fuel ratio feedback correction value, and the learned air-fuel ratio correction value of a corresponding one of the divided regions of the engine operating range.

2. A method of learning and controlling the air-fuel ratio of an internal combustion engine as set forth in claim 1, wherein a deviation of the air-fuel ratio feedback correction value from a target of convergence is detected, and when the deviation exceeds a predetermined extent, the learning process is repeated from the large regions of the engine operating range.

3. A method of learning and controlling the air-fuel ratio of an internal combustion engine as set forth in claim 1, wherein a learned region is found among the divided regions of the engine operating range of the learning map, and according to a learned air-fuel ratio correction value stored for the learned region, learned air-fuel ratio correction values stored for unlearned regions around the learned region are corrected and updated.

4. A method of learning and controlling the air-fuel ratio of an internal combustion engine as set forth in claim 1, wherein a learned air-fuel ratio correction value stored for a particular one of the divided regions of the learning map is rewritten according to learned air-fuel ratio correction values stored in a plurality of subdivided regions contained in the particular divided region.

5. A method of learning and controlling the air-fuel ratio of an internal combustion engine as set forth in claim 1, wherein a learned air-fuel ratio correction value stored for a particular one of the divided regions of the learning map is rewritten after resetting and initializing learned air-fuel ratio correction values stored in a plurality for subdivided regions contained in the particular divided region.

6. An apparatus for learning and controlling the air-fuel ratio of an internal combustion engine comprising:

an operating condition detecting means for detecting the operating condition of the engine including at least an operating parameter related to the quantity of air drawn into the engine;

a basic fuel supply quantity setting means for setting a basic fuel supply quantity according to the operating condition detected by the operating condition detecting means;

an air-fuel ratio detecting means for detecting the fir-fuel ratio of a mixture of gases drawn into the engine;

an air-fuel ratio feedback correction value setting means for comparing the air-fuel ratio detected by the air-fuel ratio detecting means with a target air fuel ratio and determining an air-fuel ratio feedback correction value for correcting the basic fuel supply quantity to bring an actual air-fuel ratio close to the target air-fuel ratio;

an learned correction value string means having a plurality of learning maps in which an engine operating range is divided into regions of different sizes, for string learned air-fuel ratio correction values for the respective divided regions of the learning maps, the stored values being able to be rewritten;

a learned correction value rewriting means for learning a deviation of the air-fuel ratio feedback correction value determined by the air-fuel ratio feedback correction value setting means from a target of convergence, and rewriting learned air-fuel ratio correction values stored in the learned correction value storing means one by one to reduce the deviation;

a learning progress control means for controlling the learned correction value rewriting means such that the learned air-fuel ratio correction values stored for the divided regions are rewritten in descending order of the sizes of the divided regions of the learning maps of the learned correction value string means;

a fuel supply quantity setting means for correcting the basic fuel supply quantity according to a learned air-fuel ratio correction value which corresponds to the present engine operating condition and stored in the learning map of the learned correction value string means, as well as the air-fuel ratio feedback correction value, thereby providing a final fuel supply quantity; and a fuel supply control means for controlling and driving a fuel supply means according to the fuel supply quantity set by the fuel supply quantity setting means.

7. An apparatus for learning and controlling the air-fuel ratio of an internal combustion engine as set forth in claim 6, further comprising a learning repeating means for detecting a deviation of the air-fuel ratio feedback correction value from a target of convergence, and repeating the learning process from the large regions of the engine operating range if the deviation exceeds a predetermined level.

8. An apparatus for learning and controlling the air-fuel ratio of an internal combustion engine as set forth in claim 6, further comprising an unlearned region estimating means for finding a learned region among the divided regions of the learning maps of the learned correction value string means, and according to a learned air-fuel ratio stored in the found learned region, rewriting the air-fuel ratio correction values of unlearned driving regions around the found learned region.

9. An apparatus for learning and controlling the air-fuel ratio of an internal combustion engine as set forth in claim 6, further comprising a means for rewriting the learned correction value of a particular one of the divided regions of the engine operating range of the learning map stored in the learned correction value storing means according to learned air-fuel ratio correction values stored in a plurality of subdivided regions contained in the particular region.

10. An apparatus for learning and controlling the air-fuel ratio of an internal combustion engine s set forth in claim 6, further comprising a resetting means for resetting and initializing the learned air-fuel ratio correction values stored in subdivided regions contained in a particular large region of the engine operating range of the learning map of the learned correction value storing means when learning and rewriting a learned air-fuel ratio correction value of the particular large region.

* * * * *